US009663328B2

(12) United States Patent
Guilani et al.

(10) Patent No.: US 9,663,328 B2
(45) Date of Patent: May 30, 2017

(54) ELEVATOR SYSTEM BELT

(75) Inventors: Brad Guilani, Woodstock Valley, CT (US); Mark Steven Thompson, Tolland, CT (US); Kyle B. Martin, Avon, CT (US); Hong Yang, Avon, CT (US); Peter Keyo, Canton, CT (US); David Wayne Mckee, Somers, CT (US); Russell Bruce Gottlieb, Canton, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 247 days.

(21) Appl. No.: 14/357,367

(22) PCT Filed: Nov. 10, 2011

(86) PCT No.: PCT/US2011/060130

§ 371 (c)(1),
(2), (4) Date: Jun. 17, 2014

(87) PCT Pub. No.: WO2013/070224

PCT Pub. Date: May 16, 2013

(65) Prior Publication Data

US 2014/0291076 A1 Oct. 2, 2014

(51) Int. Cl.
*B66B 7/06* (2006.01)
*B66B 11/00* (2006.01)
(Continued)

(52) U.S. Cl.
CPC ..... *B66B 7/062* (2013.01); *B66B 11/008* (2013.01); *D07B 1/06* (2013.01); *D07B 1/22* (2013.01);
(Continued)

(58) Field of Classification Search
CPC ..... B66B 7/062; B66B 11/008; D01B 1/0613; D01B 1/062; D01B 1/0673; D01B 1/22
See application file for complete search history.

(56) References Cited

U.S. PATENT DOCUMENTS 4,227,041 A * 10/1980 Den ..... H01B 7/0823 174/113 R
4,724,929 A 2/1988 Coleman et al.
(Continued)

FOREIGN PATENT DOCUMENTS

CN 1346329 A 4/2002
CN 1370251 A 9/2002
(Continued)

OTHER PUBLICATIONS

State Intellectual Property Office of People's Republic China Office Action and Search Report; Application No. 201180074760.1; Mailing Date Jul. 21, 2015; 7 pages.
(Continued)

*Primary Examiner* — Minh Truong
(74) *Attorney, Agent, or Firm* — Cantor Colburn LLP

(57) ABSTRACT

A belt for suspending and/or driving an elevator car includes a plurality of wires arranged into a plurality of cords. The plurality of cords includes one or more inner cords located at an innermost portion of the belt relative to a lateral end of the belt and one or more outer cords located laterally outboard of the one or more inner cords. The one or more outer cords have a construction distinct from the one or more inner cords. A jacket substantially retains the plurality of cords.

17 Claims, 8 Drawing Sheets

(51) Int. Cl.
*D07B 1/06* (2006.01)
*D07B 1/22* (2006.01)

(52) U.S. Cl.
CPC ..... *D07B 2201/1016* (2013.01); *D07B 2501/2007* (2013.01)

(56) References Cited

U.S. PATENT DOCUMENTS

| | | | | |
|---|---|---|---|---|
| 5,461,850 | A | 10/1995 | Bruyneel et al. | |
| 6,318,504 | B1 | 11/2001 | De Angelis | |
| 6,364,063 | B1 | 4/2002 | Aulanko et al. | |
| 6,419,208 | B1 | 7/2002 | Baranda et al. | |
| 6,672,046 | B1 | 1/2004 | Prewo et al. | |
| 6,837,340 | B2 * | 1/2005 | Strauss | B66B 7/068 187/266 |
| 8,252,411 | B2 * | 8/2012 | Veronesi | B66B 7/062 294/74 |
| 2002/0092285 | A1 | 7/2002 | Aulanko et al. | |
| 2013/0237358 | A1 | 9/2013 | Hollowell et al. | |
| 2013/0270043 | A1 | 10/2013 | Wesson et al. | |
| 2014/0008154 | A1 | 1/2014 | Wesson et al. | |
| 2014/0076669 | A1 * | 3/2014 | Wesson | B66B 7/062 187/254 |
| 2014/0305744 | A1 * | 10/2014 | Kere | B66B 7/1238 187/254 |

FOREIGN PATENT DOCUMENTS

| | | | |
|---|---|---|---|
| CN | 1491302 | A | 4/2004 |
| CN | 102124159 | A | 7/2011 |
| CN | 102177292 | A | 9/2011 |
| CN | 102209678 | A | 10/2011 |
| GB | 2021846 | A | 12/1979 |
| JP | 48015497 | | 5/1973 |
| JP | 06042119 | | 11/1994 |
| JP | 09-021084 | A | 1/1997 |
| JP | 0921084 | A | 1/1997 |
| JP | 2003507286 | A | 2/2003 |
| WO | 9829327 | | 7/1998 |
| WO | 0114630 | A1 | 3/2001 |
| WO | 02064480 | A1 | 8/2002 |

OTHER PUBLICATIONS

EP Search Report (extended); Application No. 11875479.5-1705 / 27776354; dated Jul. 27, 2015; 5 pages.
Japanese Office Action for Application No. 2014541018; Issued Mar. 3, 2015; 3 pages.
Notification of Transmittal of the International Search Report and the Written Opinion of the International Searching Authority, or the Declaration; PCT/US2011/060130; Oct. 16, 2012; 11 pages.
State Intellectual Property Office, P.R. China; Second Office Action and Search Report; Application No. 201180074760.1; Date of Issue: Mar. 21, 2016; 5 pages.

* cited by examiner

ELEVATOR SYSTEM BELT

BACKGROUND OF THE INVENTION

The subject matter disclosed herein relates to elevator systems. More specifically, the subject disclosure relates to tension members for elevator suspension and/or driving.

Elevator systems utilize a lifting means, such as ropes or belts operably connected to an elevator car, and routed over one or more sheaves, also known as pulleys, to propel the elevator along a hoistway. Lifting belts in particular typically include a plurality of wires at least partially within a jacket material. The plurality of wires are often arranged into one or more strands and the strands are then arranged into one or more cords.

Wire arrangements are typically designed with at least three basic requirements in mind, breaking strength, cord life, and torque or twist. The total cross-sectional area of steel used in the cord is the primary determinant of breaking strength of the cord. A large number of small cross-section wires are typically avoided for cost and manufacturing reasons and large cross-section wires would be expected to have a limited fatigue life thus limiting the overall life of the cord. Further, nearly equal wire cross-sectional areas are typically preferred, since the largest wire usually has the shortest fatigue life and becomes the limiting element when determining cord life.

In a lifting belt construction, a plurality of cords are typically arranged equally spaced within a jacket in a longitudinal direction, the cords having alternating S and Z lay directions. To maintain belts that lack guidance features (e.g. ribs or poly-V configurations) centered on sheaves of the elevator system, the sheaves include a convex crown feature. Incorporation of such a crown on the sheaves influences mechanical and fatigue behavior of the cords, for example those cords furthest from the peak of the crown are most lightly loaded.

BRIEF DESCRIPTION OF THE INVENTION

According to one aspect of the invention, a belt for suspending and/or driving an elevator car includes a plurality of wires arranged into a plurality of cords. The plurality of cords includes one or more inner cords located at an innermost portion of the belt relative to a lateral end of the belt and one or more outer cords located laterally outboard of the one or more inner cords. The one or more outer cords have a construction distinct from the one or more inner cords. A jacket substantially retains the plurality of cords.

Alternatively in this or other aspects of the invention, the one or more outer cords are formed of a plurality of wires having a different diameter than those of the one or more inner cords.

Alternatively in this or other aspects of the invention, the plurality of wires in the one or more outer cords are formed into a plurality of strands.

Alternatively in this or other aspects of the invention, the plurality of strands comprises a core surrounded by a plurality of outer strands twisted in either a right hand direction or left hand direction.

Alternatively in this or other aspects of the invention, the core of each of the outer cords is formed of a different material than a core of each of the inner cords.

Alternatively in this or other aspects of the invention, the core of each outer cord is non-metallic.

Alternatively in this or other aspects of the invention, the one or more outer cords are about 50% of a total number of cords of the belt.

Alternatively in this or other aspects of the invention, the one or more outer cords are two cords in a multi-cord belt.

According to another aspect of the invention, an elevator system includes an elevator car, one or more sheaves, and one or more belts operably connected to the car and interactive with the one or more sheaves for suspending and/or driving the elevator car. At least one belt of the one or more belts include a plurality of wires arranged into a plurality of cords. The plurality of cords includes one or more inner cords located at an innermost portion of the belt relative to a lateral end of the belt and one or more outer cords located laterally outboard of the one or more inner cords, the one or more outer cords having a construction distinct from the one or more inner cords. A jacket substantially retains the one or more cords.

Alternatively in this or other aspects of the invention, at least one sheave of the one or more sheaves includes a convex crown along an axis of rotation.

The detailed description explains the invention, together with advantages and features, by way of examples with reference to the drawings.

DETAILED DESCRIPTION OF THE INVENTION

Figure 1A:
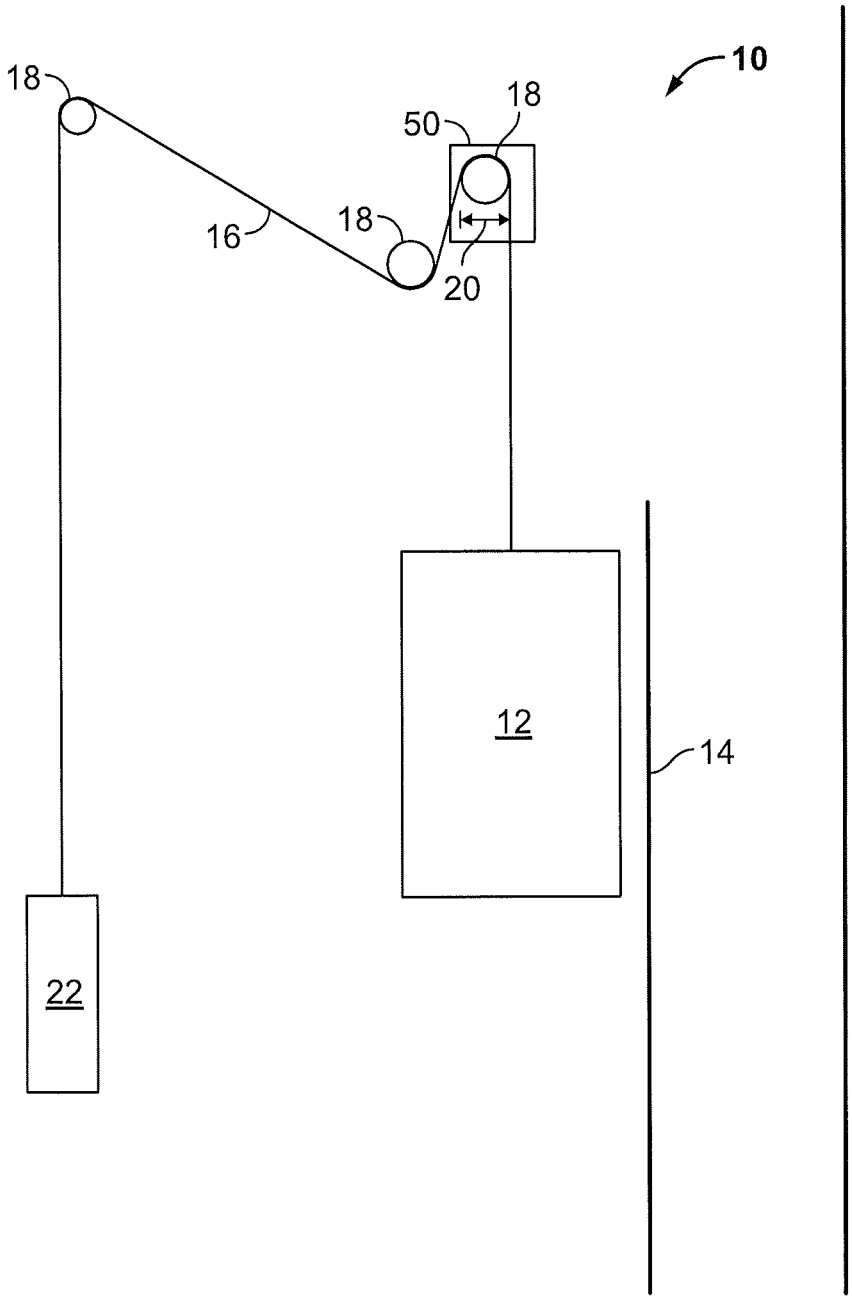
FIG. 1A is a schematic of an exemplary elevator system having a 1:1 roping arrangement.
Figure 1B:
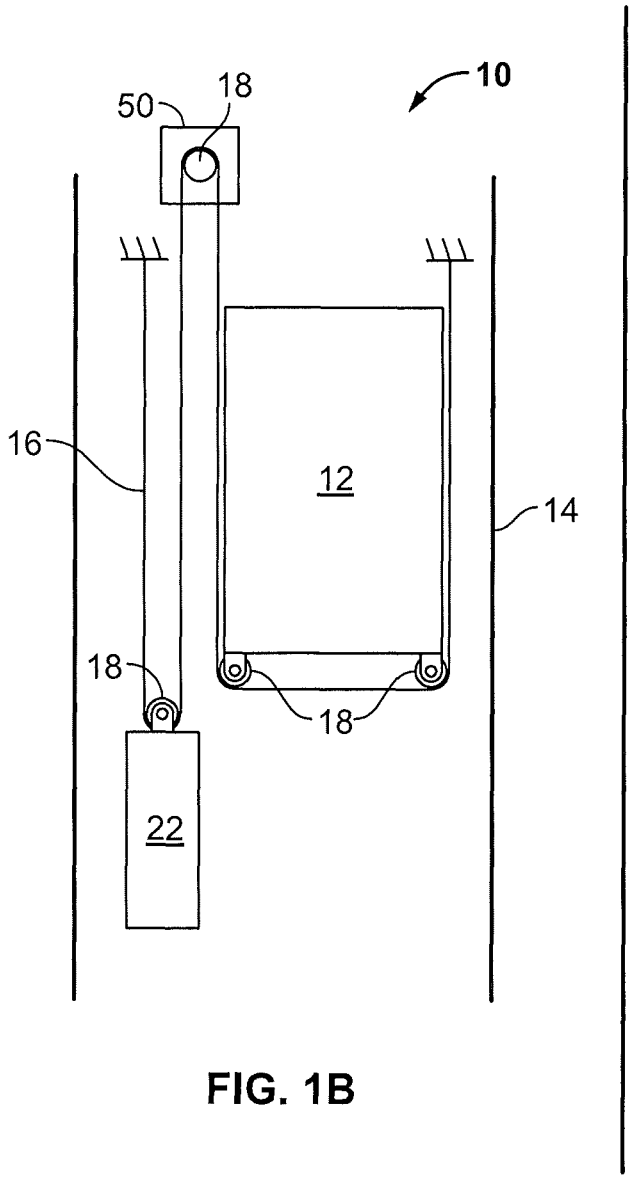
FIG. 1B is a schematic of another exemplary elevator system having a different roping arrangement.
Figure 1C:
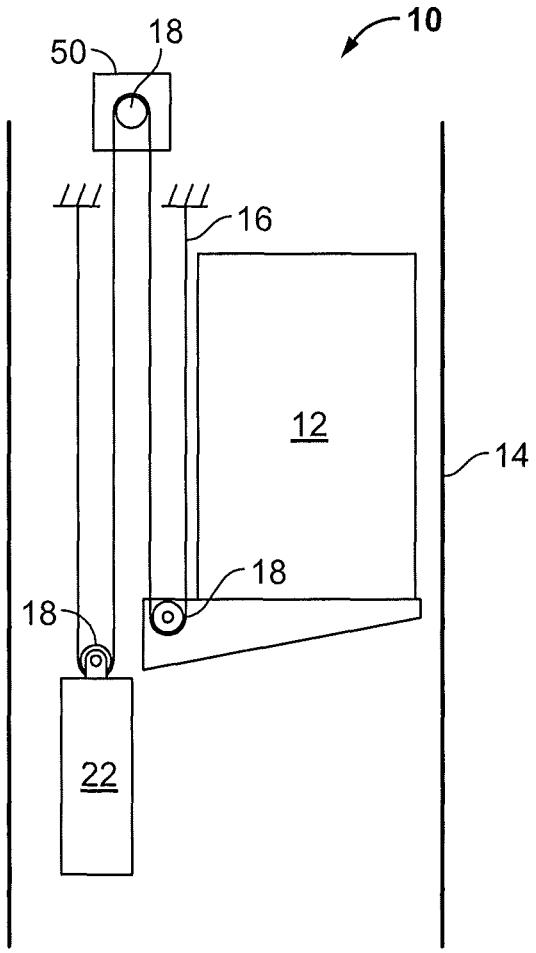
FIG. 1C is a schematic of another exemplary elevator system having a cantilevered arrangement.

Shown in FIGS. 1A, 1B and 1C are schematics of exemplary traction elevator systems 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more belts 16. The one or more belts 16 interact with one or more sheaves 18 to be routed around various components of the elevator system 10. The one or more belts 16 could also be connected to a counterweight 22, which is used to help balance the elevator system 10 and reduce the difference in belt tension on both sides of the traction sheave during operation.

The sheaves 18 each have a diameter 20, which may be the same or different than the diameters of the other sheaves 18 in the elevator system 10. At least one of the sheaves 18 could be a drive sheave. A drive sheave is driven by a machine 50. Movement of drive sheave by the machine 50 drives, moves and/or propels (through traction) the one or more belts 16 that are routed around the drive sheave.

At least one of the sheaves 18 could be a diverter, deflector or idler sheave. Diverter, deflector or idler sheaves are not driven by a machine 50, but help guide the one or more belts 16 around the various components of the elevator system 10. Further, one or more of the sheaves 18, such as the diverter, deflector or idler sheaves, may have a convex shape or crown along its axis of rotation to assist in keeping the one or more belts 16 centered, or in a desired position, along the sheaves 18.

In some embodiments, the elevator system 10 could use two or more belts 16 for suspending and/or driving the elevator car 12. In addition, the elevator system 10 could have various configurations such that either both sides of the one or more belts 16 engage the one or more sheaves 18 (such as shown in the exemplary elevator systems in FIG. 1A, 1B or 1C) or only one side of the one or more belts 16 engages the one or more sheaves 18.

FIG. 1A provides a 1:1 roping arrangement in which the one or more belts 16 terminate at the car 12 and counterweight 22. FIGS. 1B and 1C provide different roping arrangements. Specifically, FIGS. 1B and 1C show that the car 12 and/or the counterweight 22 can have one or more sheaves 18 thereon engaging the one or more belts 16 and the one or more belts 16 can terminate elsewhere, typically at a structure within the hoistway 14 (such as for a machineroomless elevator system) or within the machine room (for elevator systems utilizing a machine room. The number of sheaves 18 used in the arrangement determines the specific roping ratio (e.g. the 2:1 roping ratio shown in FIGS. 1B and 1C or a different ratio). FIG. 1C also provides a cantilevered type elevator. The present invention could be used on elevator systems other than the exemplary types shown in FIGS. 1A, 1B and 1C.

Figure 2:
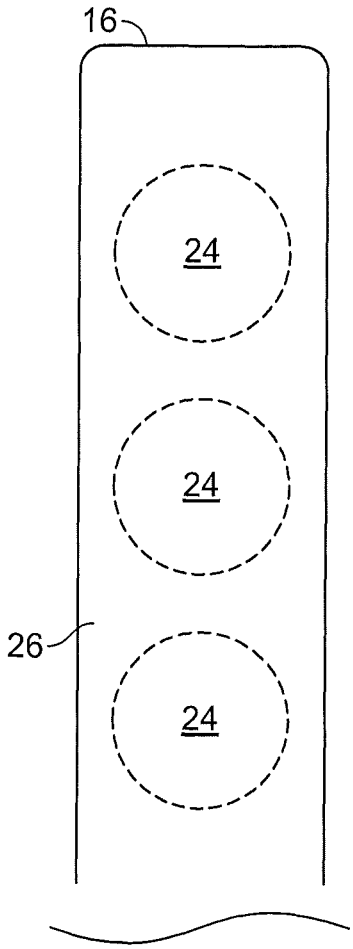
FIG. 2 is a cross-sectional view of an exemplary elevator belt.

FIG. 2 provides a schematic of an exemplary belt construction or design. Each belt 16 is constructed of one or more cords 24 in a jacket 26. As seen in FIG. 2, the belt 16 has an aspect ratio greater than one (i.e. belt width is greater than belt thickness).

The belts 16 are constructed to have sufficient flexibility when passing over the one or more sheaves 18 to provide low bending stresses, meet belt life requirements and have smooth operation, while being sufficiently strong to be capable of meeting strength requirements for suspending and/or driving the elevator car 12.

The jacket 26 could be any suitable material, including a single material, multiple materials, two or more layers using the same or dissimilar materials, and/or a film. In one arrangement, the jacket 26 could be a polymer, such as an elastomer, applied to the cords 24 using, for example, an extrusion or a mold wheel process. In another arrangement, the jacket 26 could be a woven fabric that engages and/or integrates the cords 24. As an additional arrangement, the jacket 26 could be one or more of the previously mentioned alternatives in combination.

The jacket 26 can substantially retain the cords 24 therein. The phrase substantially retain means that the jacket 26 has sufficient engagement with the cords 24 to transfer torque from the machine 50 through the jacket 26 to the cords 24 to drive movement of the elevator car 12. The jacket 26 could completely envelop the cords 24 (such as shown in FIG. 2), substantially envelop the cords 24, or at least partially envelop the cords 24.

Figure 3:
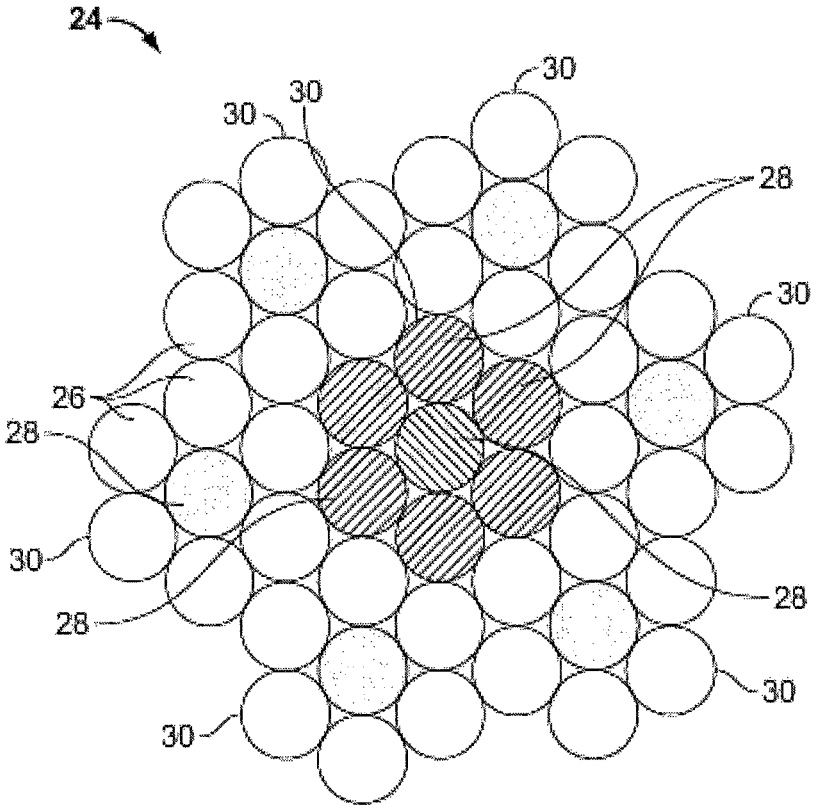
FIG. 3 PRIOR ART
FIG. 3 is a cross-sectional view of a prior art cord for an elevator belt.

Referring now to FIG. 3, each cord 24 comprises a plurality of wires 28 in a geometrically stable arrangement. Optionally, some or all of these wires 28 could be formed into strands 30, which are then formed into the cord 24. The cords 24 are twisted in either a right hand direction (S lay direction) or a left hand direction (Z lay direction). The phrase geometrically stable arrangement means that the wires 28 (and if used, strands 30) generally remain at their theoretical positions in the cord 24.

Figure 4:
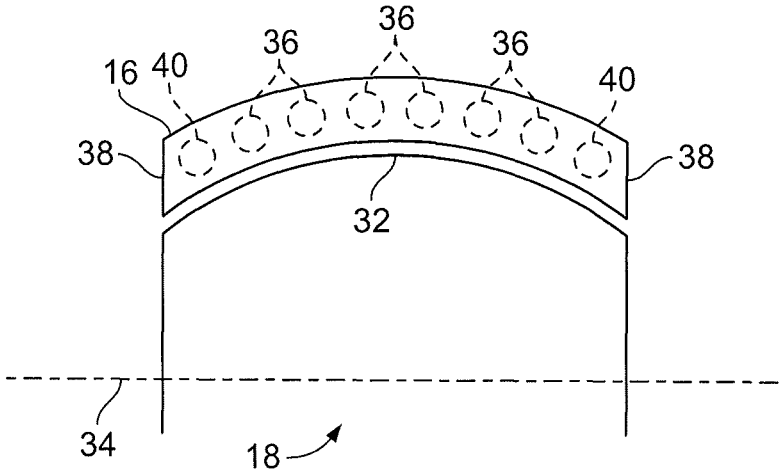
FIG. 4 is a cross-sectional view of an embodiment of an elevator belt.
Figure 5:
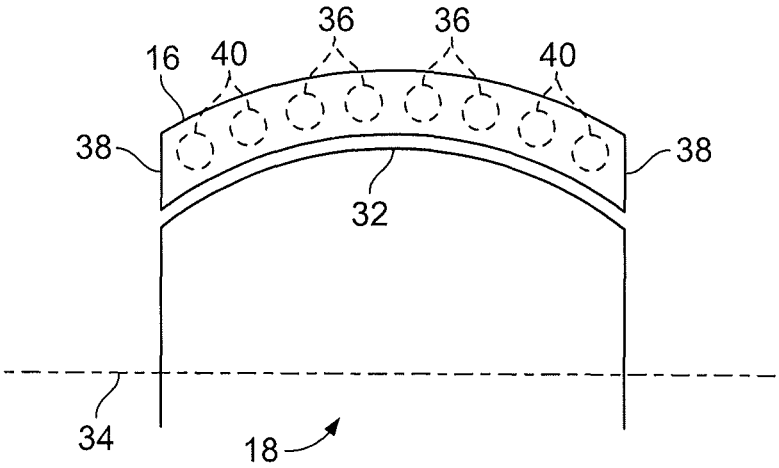
FIG. 5 is a cross-sectional view of another embodiment of an elevator belt.
Figure 6:
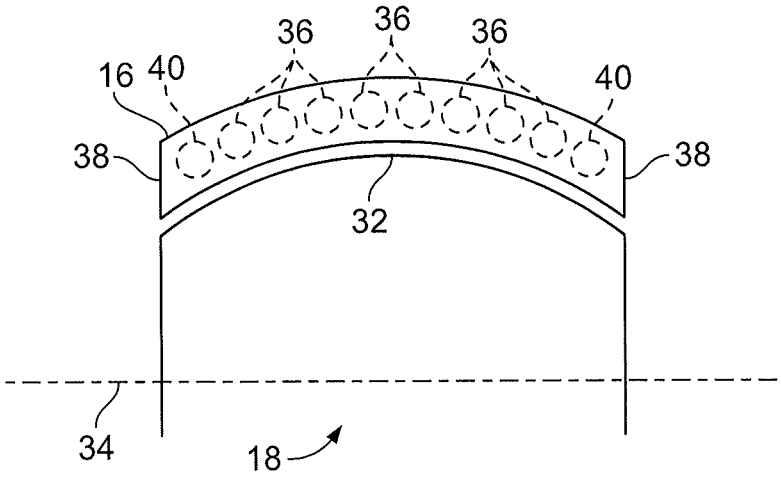
FIG. 6 is a cross-sectional view of another embodiment of an elevator belt.
Figure 7:
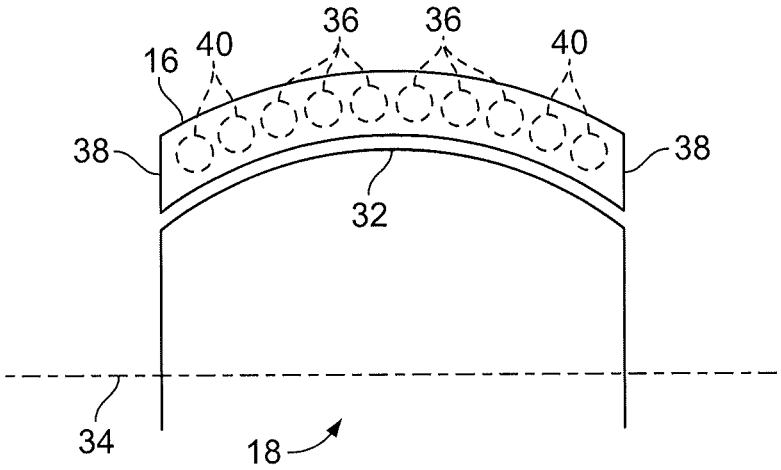
FIG. 7 is a cross-sectional view of another embodiment of an elevator belt.

Referring now to FIG. 4, the belt 16 is shown passing over a sheave 18 having a convex crown 32 along the sheave's axis of rotation 34. The belt 16 shown in FIG. 4 includes eight cords arranged in the belt 16. The number of cords 24 used in a belt 16 depends on the particular application. The cords comprise inner cords 36 arranged at an innermost portion of the belt 16 relative to lateral ends 38 of the belt 16, and outer cords 40, configured differently from the inner cords 36, located outboard of the inner cords 36. While FIG. 4 illustrates an eight-cord belt 16 having six inner cords 36 and two outer cords 40, this configuration is merely exemplary. Other configurations are contemplated within the scope of the present disclosure, for example but not limited to, those shown in FIGS. 5-7. FIG. 5 illustrates an eight-cord belt 16 having four inner cords 36 and four outer cords 40. FIG. 6 illustrates an embodiment of a ten-cord belt 16 having eight inner cords 36 and two outer cords 40, and FIG. 7 illustrates an embodiment of a ten-cord belt 16 having six inner cords 36 and four outer cords 40. The ratio of outer cords 40 to total cords (and, similarly, the ratio of inner cords 36 to total cords) depends on the particular application. For example, outer cords 40 could comprise up to about 50% of the total number of cords 24 in the belt 16. Outer cords 40 comprise 20% of the total number of cords 24 in the belt 16 of FIG. 6, while the outer cords 40 comprise 50% of the total number of cords 24 in the belt 16 of FIG. 5.

Because of the crown 32 of the sheave 18, an outer portion of the belt 16 is subjected to different stress and strain conditions than an inner portion of the belt 16, thus the outer cords 40 are configured differently than the inner cords 36 resulting in a belt 16 construction that takes advantage of the differing load conditions. For example, in some embodiments, the outer portion of the belt 16 is subjected to lower stress and/or strain conditions than the inner portion of the belt 16. Thus, for example, a wire 28 size of at least some of the wires 28 of the outer cords 40 may be reduced, in the range of about 5% to about 20%, to increase flexibility in the outer cords 40, thus increasing fatigue life in the outer cords 40. In other embodiments, for example, a lay length may be modified between the inner cords 36 and the outer cords 40. In some embodiments, a lay length of the outer cords 40 is shorter than a lay length of the inner cords 36, thus increasing flexibility of the outer cords 40. For example, in one embodiment a lay length of the inner cords 36 may be about 20 mm, while a lay length of the outer cord 40 may be about 15 mm.

Figure 8:
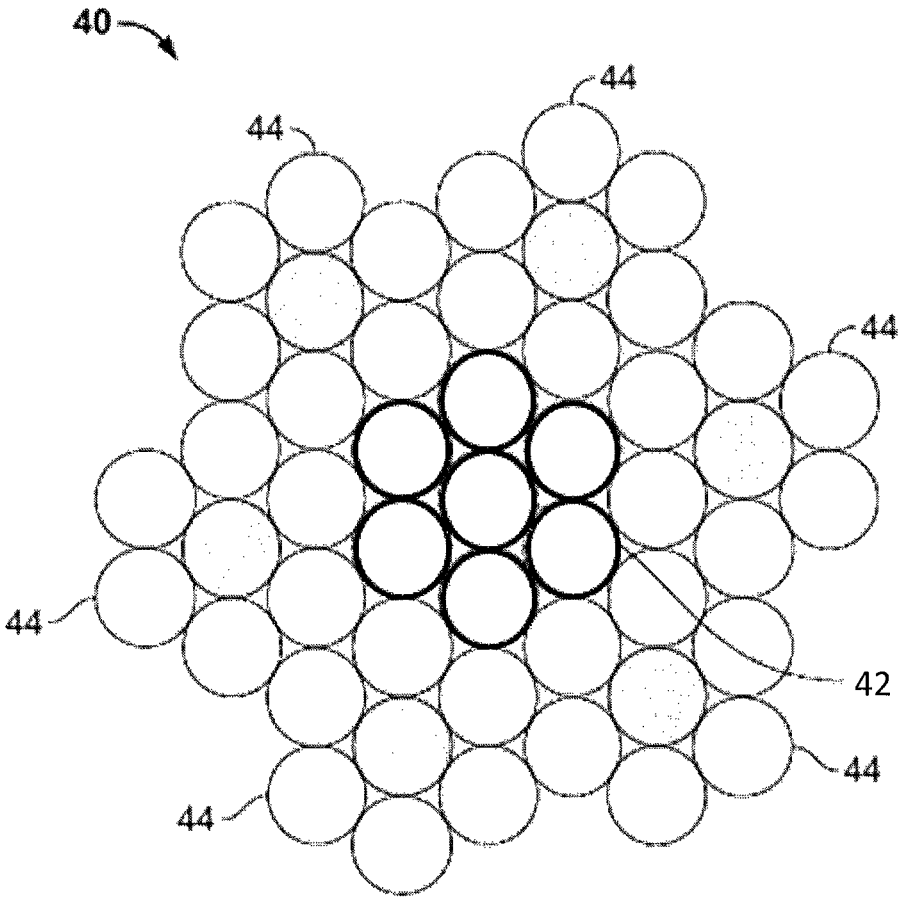
FIG. 8 is a cross-sectional view of another embodiment of an elevator belt.

Referring now to FIG. 8, in some embodiments, the outer cords 40 and/or inner cords 36 include a center strand or core 42, also known as a "king strand", surrounded by a plurality of outer strands 44. In the embodiment of FIG. 8, the outer cords 40 each have a core 42 configured differently from the cores 42 of the inner cords 36. For example, the core 42 of the outer cords 40 may have a smaller wire or strand diameter, for example, about 10% smaller, than the core 42 of the inner cords 36, or may have a nonmetallic, non-load carrying, core 42. In such embodiments, a wire size of the outer strands 44 of the outer cords 40 may be increased to preserve the load rating of the outer cords 40. Further, a core

42 lay length of the outer cord 40 may be different that a core 42 lay length of the inner cord 36. For example, in one embodiment, the core lay length of the outer cord 40 may be about 7.5 mm, while the core 42 lay length of the inner cord 36 is about 12 mm.

In other embodiments, outer cords 40 and inner cords 36 having different lay configurations may be utilized to balance forces on the belt 16 over the crown 32 of the sheave 18. Different lay configurations include szS, zsZ, ssZ and zzS, where "s" and "S" connote a left handed twist or "lay", while "z" and "Z" connote a right handed lay. For example, in a szS cord, the core 42 has a left-handed twist and outer strands 44 have a right-handed twist. The overall cord 40, 36 twist (denoted by the capital "S") is left-handed.

As an additional possibility, the belt 16 could include one or more additional configurations of cords 24 that are different than inner cords 36 and outer cords 40. In other words, the belt 16 could have three or more different configurations of cords 24. Utilizing cords 24 of different configurations as described herein allows the load of each cord 24 to be equalized to increase belt 16 life. With cord 24 loads equalized, the life (fatigue response) is also equalized, thus stabilizing be belt 16 over the crown 32. Although the above description has described the differing cord 24 configurations being used in a belt 16 that engages a sheave 18 with a crown 32, the differing cord 24 configurations could be used in belts 16 that engage, additional or alternatively, sheaves with other arrangements (such as a sheave without a crown 32).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A belt for suspending and driving an elevator car, comprising:

a plurality of cords, each cord of the plurality of cords formed from a plurality of wires and configured for suspending and/or driving the elevator car, the plurality of cords including one or more inner cords disposed at an innermost portion of the belt relative to a lateral end of the belt and one or more outer cords disposed laterally outboard of the one or more inner cords, the one or more outer cords having a construction distinct from the one or more inner cords such that the one or more outer cords have an outer cord flexibility greater than an inner cord flexibility of the one or more inner cords; and a jacket substantially retaining the plurality of cords;

wherein the different construction of the one or more outer cords includes the outer cords being formed from wires of a first diameter, different than a second diameter of wires utilized to form the one or more inner cords.

2. The belt of claim 1, wherein the plurality of wires in the one or more outer cords are formed into a plurality of strands.

3. The belt of claim 2, wherein an outer cord of the one or more outer cords includes a core surrounded by the plurality of strands.

4. The belt of claim 3, wherein the core of each of the outer cords is formed of a different material than a core of each of the inner cords.

5. The belt of claim 4, wherein the core of each outer cord is non-metallic.

6. The belt of claim 1, wherein the one or more outer cords comprise up to about 50% of a total number of cords of the belt.

7. The belt of claim 1, wherein the one or more outer cords comprise two cords of a multi-cord belt.

8. The belt of claim 1, wherein the plurality of wires of the outer cords have a lay length that is less than a lay length of the plurality of wires of the inner cords.

9. The belt of claim 1, wherein the belt construction is substantially symmetrically about a lateral center of the belt.

10. A belt and sheave combination for an elevator system comprising:

an elevator car;

one or more sheaves; and one or more belts operably connected to the car and interactive with the one or more sheaves for suspending and driving the elevator car, each belt of the one or more belts including:

a plurality of cords, each cord of the plurality of cords formed from a plurality of wires, the plurality of cords including one or more inner cords disposed at an innermost portion of the belt relative to a lateral end of the belt and one or more outer cords disposed laterally outboard of the one or more inner cords, the one or more outer cords having a construction distinct from the one or more inner cords such that the one or more outer cords have an outer cord flexibility greater than an inner cord flexibility of the one or more inner cords; and a jacket substantially retaining the plurality of cords;

wherein the different construction of the one or more outer cords includes the outer cords being formed from wires of a first diameter, different than a second diameter of wires utilized to form the one or more inner cords.

11. The combination of claim 10, wherein at least one sheave of the one or more sheaves includes a convex crown along an axis of rotation.

12. The combination of claim 10, wherein the plurality of wires in the one or more outer cords are formed into a plurality of strands.

13. The combination of claim 12, wherein a cord of the one or more outer cords includes a core surrounded by the plurality of strands.

14. The combination of claim 13, wherein the core of each of the outer cords is formed of a different material than a core of each of the inner cords.

15. The combination of claim 14, wherein the core of each outer cord is non-metallic.

16. The combination of claim 10, wherein the one or more outer cords comprise about 50% of a total number of cords of the belt.

17. The combination of claim 10, wherein the one or more outer cords comprise two cords of a multi-cord belt.

* * * * *